US006179367B1

(12) United States Patent
Bowen

(10) Patent No.: US 6,179,367 B1
(45) **Date of Patent: *Jan. 30, 2001**

(54) INFLATABLE TENT FOR SPORT UTILITY VEHICLE

(76) Inventor: Frank P. H. Bowen, 6012-143A Street, Edmonton, Alberta (CA), T6H 4G6

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/108,905

(22) Filed: Jul. 1, 1998

(51) Int. Cl.[7] ..... E04H 15/06
(52) U.S. Cl. ..... 296/161; 135/88.17; 135/124
(58) Field of Search ..... 296/161; 135/88.17, 135/88.13, 127, 124

(56) References Cited

U.S. PATENT DOCUMENTS

| | | | | |
|---|---|---|---|---|
| Re. 29,264 | | 6/1977 | Woodward | 296/23 MC |
| 3,020,919 | * | 2/1962 | Crump | 135/88.13 |
| 3,863,977 | * | 2/1975 | Hardinge | 296/161 |
| 3,968,809 | * | 7/1976 | Beavers | 296/161 |
| 4,091,584 | * | 5/1978 | Brown | 135/127 |
| 4,093,302 | | 6/1978 | Adams | 296/23 R |
| 4,296,960 | | 10/1981 | Winchester | 296/167 |
| 4,867,502 | * | 9/1989 | Sylvester et al. | 296/161 |
| 4,876,829 | * | 10/1989 | Mattick . | |
| 5,205,086 | * | 4/1993 | Heim . | |
| 5,247,768 | * | 9/1993 | Russo . | |
| 5,692,795 | | 12/1997 | Mininger | 296/164 |
| 5,738,130 | * | 4/1998 | Thomas | 135/88.13 |

OTHER PUBLICATIONS

Abstract of U.S. patent No. 5,339,851, Miller, et al., Aug. 23, 1994, 2 pages.
Abstract of U.S. patent No. 5,601,104, Perkins, Feb. 11, 1997, 2 pages.
Abstract of U.S. patent No. 4,295,302, Liu, Oct. 20, 1981, 2 pages.
Abstract of U.S. patent No. 4271,642, Karr, Jun. 9, 1981, 2 pages.
Abstract of U.S. patent No. 4,031,674, Rand, Jun. 28, 1977, 2 pages.
Abstract of U.S. patent No. 5,247,768, Russo, Sep. 28, 1993, 2 pages.
Abstract of U.S. patent No. 4766918, Odekirk, Aug. 30, 1988, 2 pages.
Abstract of U.S. patent No. 5,226,689, Roe, et al., Jul. 13, 1993, 2 pages.
Abstract of U.S. patent No. 5,636,478, Chen, Jun. 10, 1997, 2 pages.
Abstract of U.S. patent No. 5,502,927, Hammerton, Apr. 2, 1996, 2 pages.
Abstract of U.S. patent No. 5,005,322, Mattick, et al., Apr. 9, 1991, 2 pages.
Abstract of U.S. patent No. 4,876,829, Mattick, Oct. 31, 1989, 2 pages.
Abstract of U.S. patent No. 5,738,130, Thomas, Apr. 14, 1998, 2 pages.

* cited by examiner

*Primary Examiner*—D. Glenn Dayoan
*Assistant Examiner*—Paul Chenevert
(74) *Attorney, Agent, or Firm*—Christensen O'Connor Johnson Kindness PLLC

(57) ABSTRACT

An inflatable tent assembly for a vehicle with a rear hatch, the inflatable tent assembly comprising an inflatable frame, which when inflated has a shape; a cover having the shape of the inflatable frame when the inflatable frame is inflated, the cover having a vehicle side and being sized to fit on the exterior of the inflatable frame; an opening on the vehicle side of the cover, the opening being bounded by a peripheral edge; and a fastener system disposed around the peripheral edge for connection to the rear hatch of the vehicle.

17 Claims, 7 Drawing Sheets

10
12
17
18
19
20
21
22
24
26
28
30
68

INFLATABLE TENT FOR SPORT UTILITY VEHICLE

FIELD OF THE INVENTION

This invention relates to tents.

BACKGROUND OF THE INVENTION

Several patents are known which describe tents attached to vehicles. For example, re-issue U.S. Pat. No. 29,264 describes a tent for a rear doored vehicle; U.S. Pat. No. 4,093,302 describes a frame tent for a cargo area of a pickup truck with an inflatable cover; and U.S. Pat. Nos. 4,296,960 and 5,692,795 describe an inflatable camper for a pickup truck. However, these tents are relatively difficult to put up, take down and/or do not provide a great deal of additional space for the user. In addition, these tents are not specifically intended for sports utility vehicles.

SUMMARY OF THE INVENTION

There is therefore provided in accordance with an aspect of the invention, an inflatable tent assembly for a vehicle with a rear hatch, the inflatable tent assembly comprising an inflatable frame, which when inflated has a shape; a cover having the shape of the inflatable frame when the inflatable frame is inflated, the cover having a vehicle side and being sized to fit on the exterior of the inflatable frame; an opening on the vehicle side of the cover, the opening being bounded by a peripheral edge; and a fastener system disposed around the peripheral edge for connection to the rear hatch of the vehicle.

According to a further aspect of the invention, an inflatable frame for a vehicle tent may comprise a first hollow end frame member having first and second ground engaging ends spaced apart a fixed distance; a second hollow end frame member having third and fourth ground engaging ends spaced apart a fixed distance; and plural hollow arcuate roof frame members extending laterally in an arc from the first end frame member to the second end frame member.

In use, in combination with a vehicle, the opening is fastened around the rear hatch of the vehicle with the fastener system. The tent may also stand alone.

An inner liner is preferably disposed on the inside of the inflatable frame and secured to the inflatable frame for added insulation.

The inflatable frame is preferably made of collapsible hollow tubes.

Objects of the invention include providing simple assembly and disassembly, security from wild animals, self-supporting, and ease of heating and cooling.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figures 1, 1A:
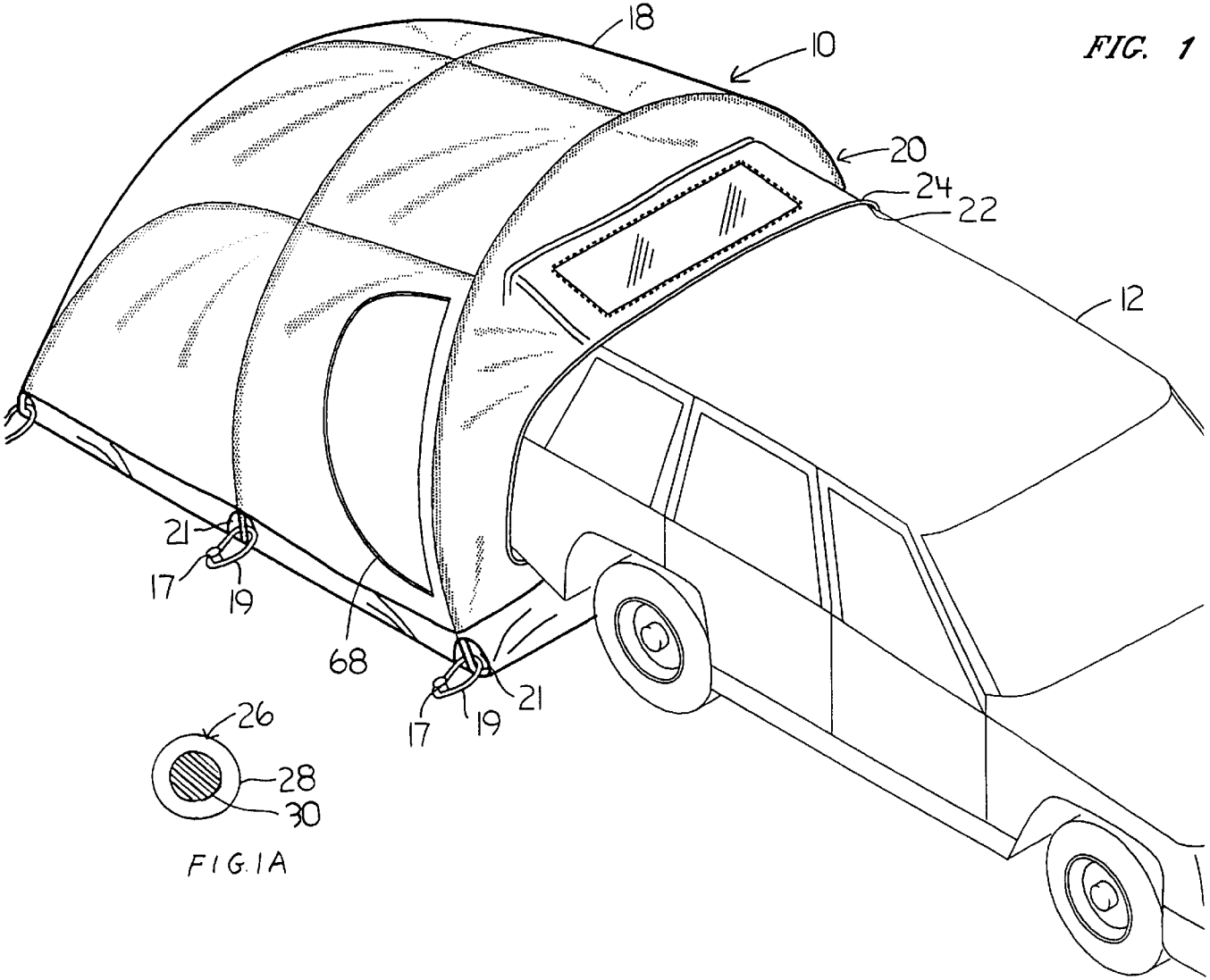
FIG. 1 is a perspective view of an inflatable tent according to the invention attached to the rear hatch of a motor vehicle, which may for example be a sport utility vehicle as shown.
Figure 2:
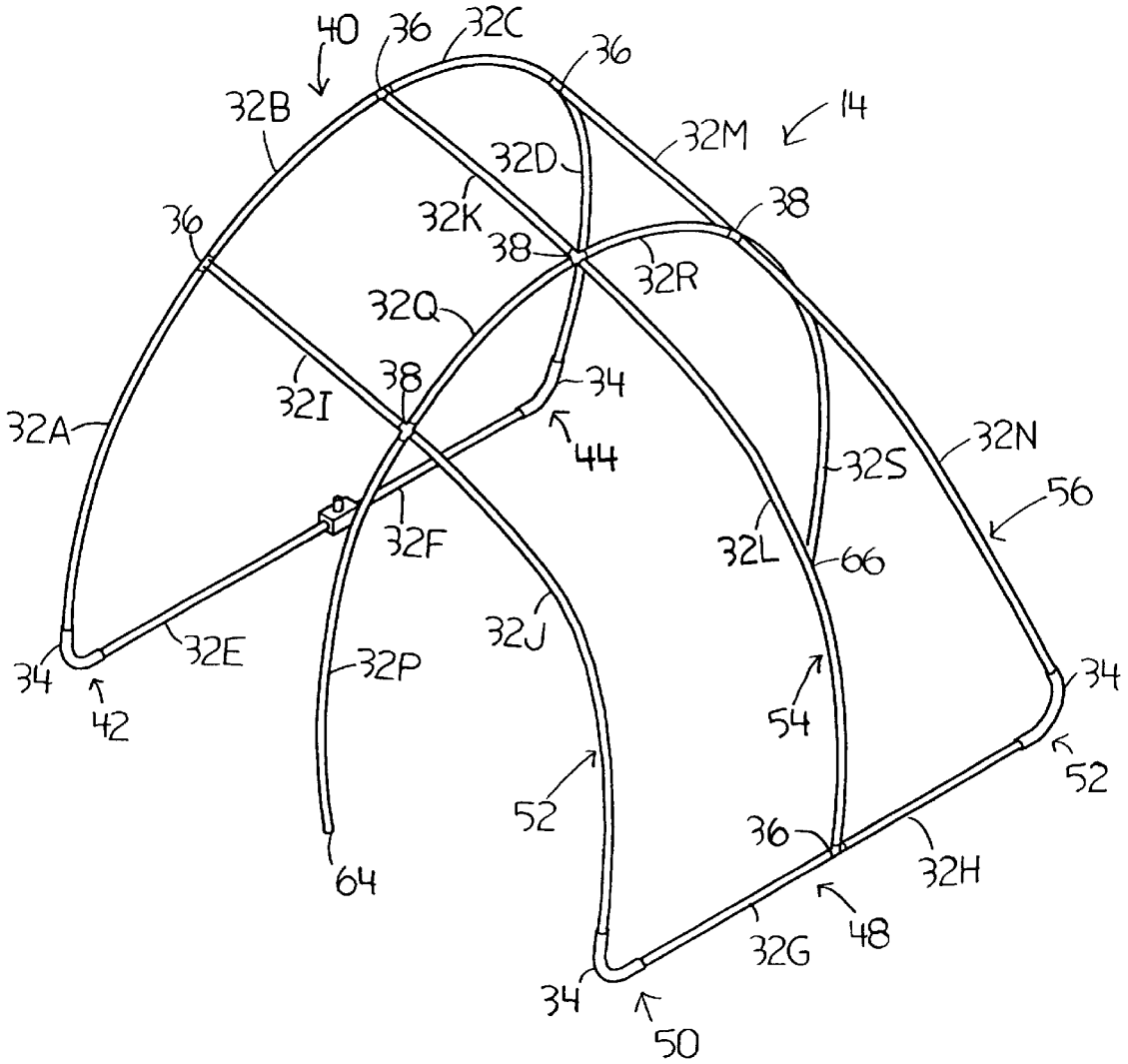
FIG. 2 is a perspective view of a frame for use with the inflatable tent of claim 1.
Figure 3:
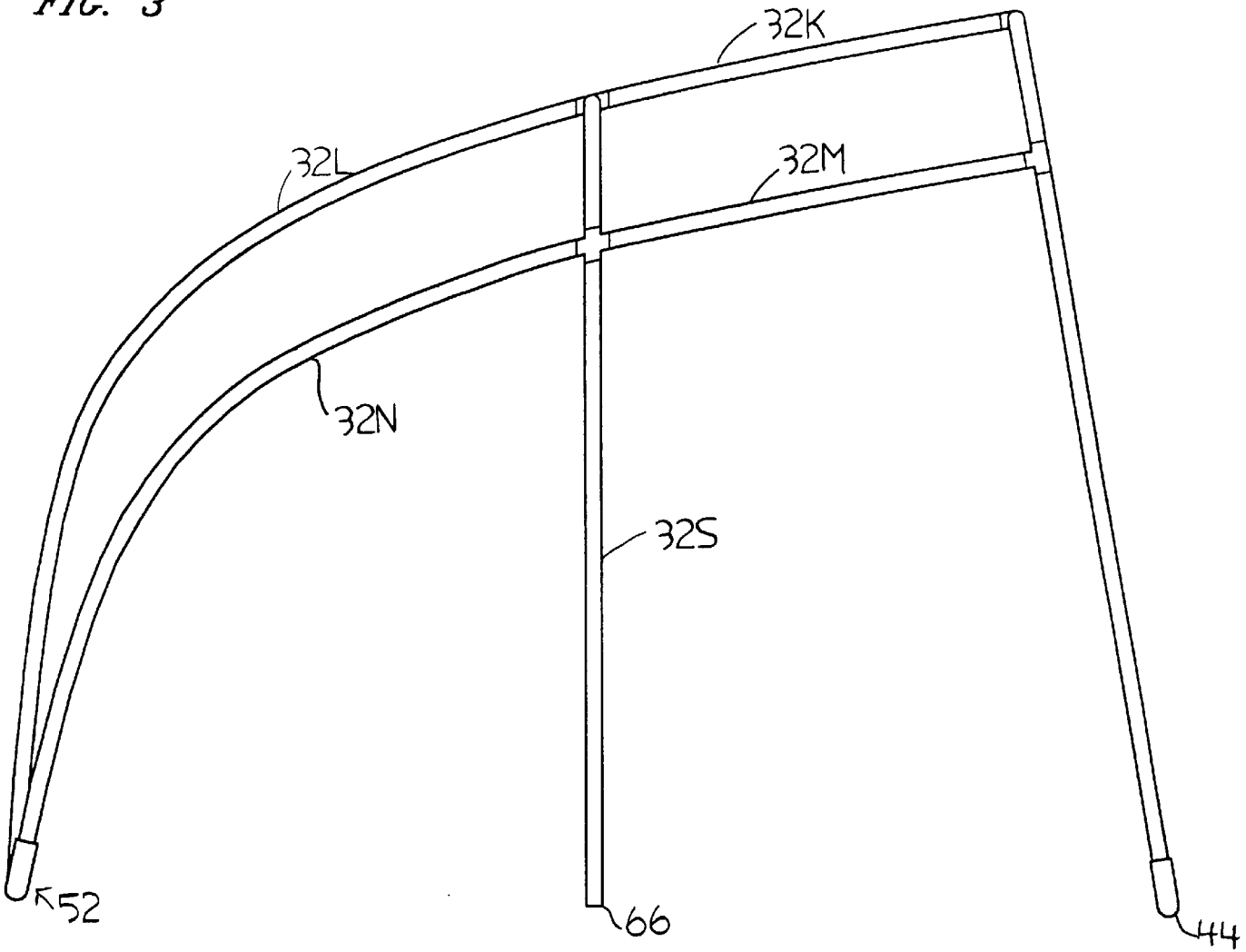
FIG. 3 is a side view of the frame of FIG. 2.
Figure 4:
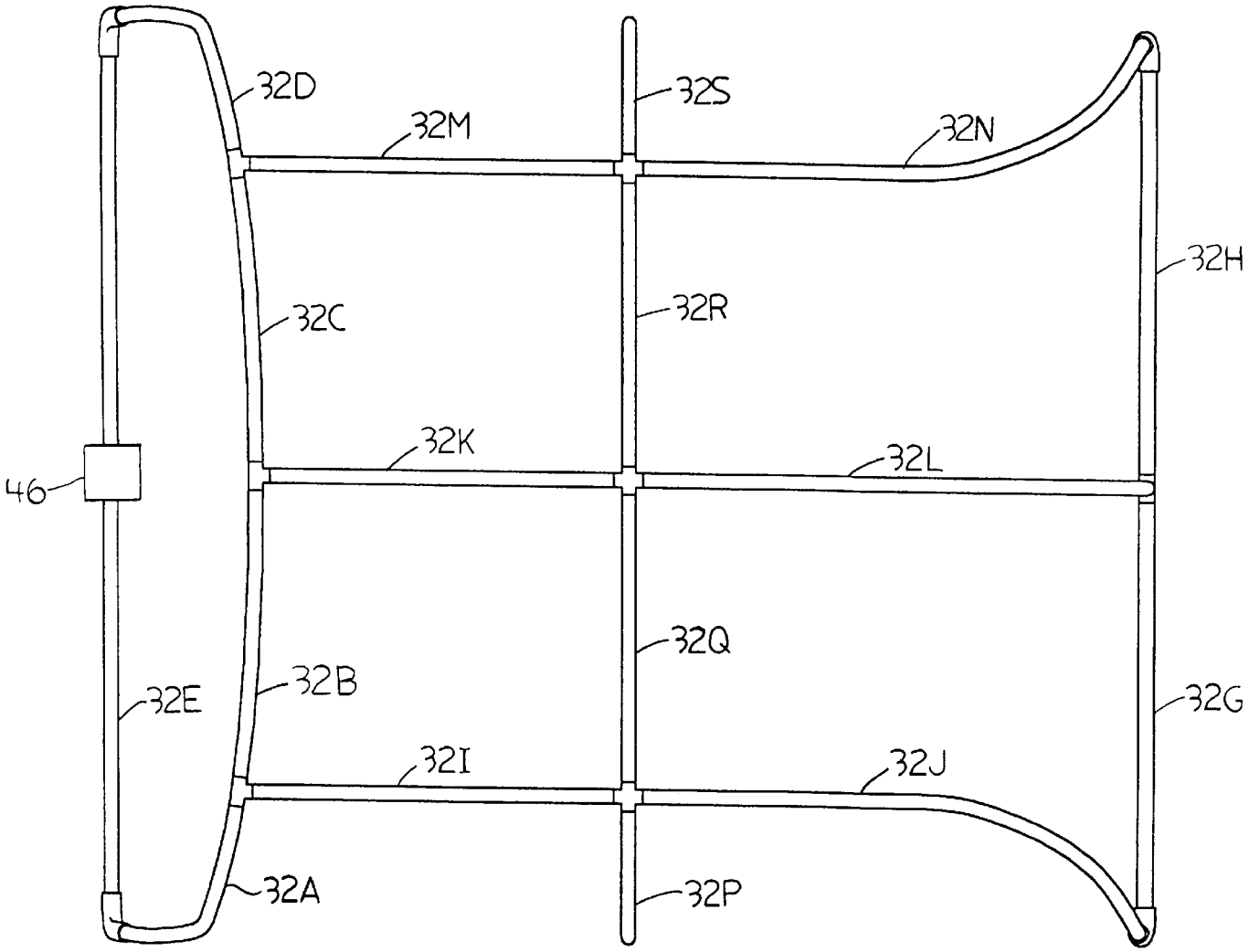
FIG. 4 is a top view of the frame of FIG. 2.
Figure 5:
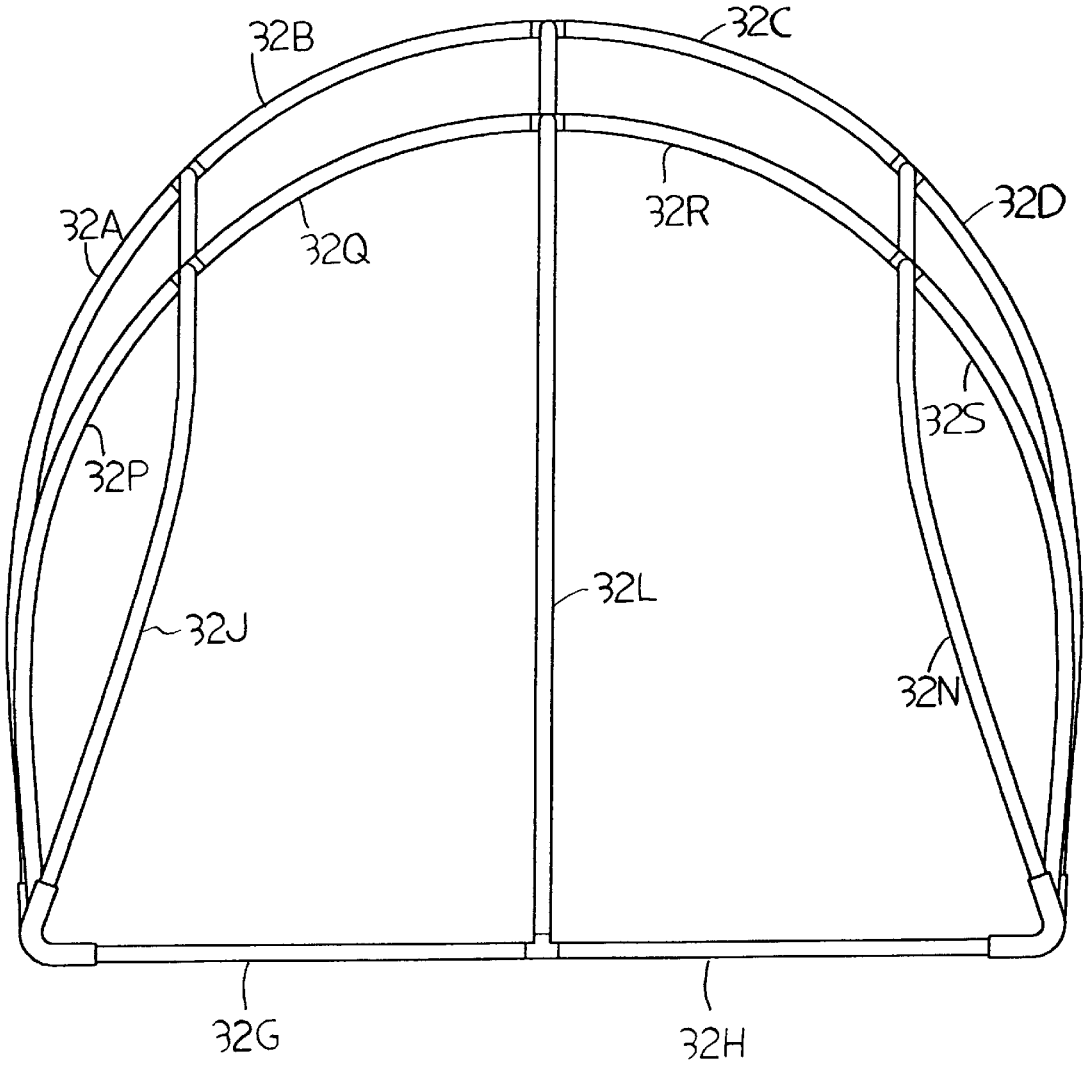
FIG. 5 is a rear view of the frame of FIG. 2.

Referring firstly to FIGS. 1 and 2, an inflatable tent assembly 10 is shown for a vehicle 12 with a rear hatch (conventional but obscured by the tent in FIG. 1). The inflatable tent assembly 10 is constructed around an inflatable frame 14, which when inflated has a shape as illustrated in FIG. 2. The configuration provides forces that extend the tent to its shape without the aid of ground attachments. The shape is close to semicircular in cross-section at one end, thus extending around the rear hatch of the vehicle, converging to the ground at the other end. A cover 18 is provided for the inflatable frame as clearly shown in FIG. 1. The cover 18 has the shape of the inflatable frame 14 when the inflatable frame 14 is inflated. The cover 18 has a vehicle side 20 and is sized to fit on the exterior of the inflatable frame 14. An opening 22 bounded by a peripheral edge 24 of the cover 18 is formed on the vehicle side of the cover 18. A fastener system 26. (FIG. 1A) is disposed around the peripheral edge 24 for connection to the rear hatch of the vehicle 12. The fastener system 26 in a preferred embodiment is formed of a loop of material 28 (a folded edge of the cover 18) enclosing an elastic cord 30 (for example a Bungi™ cord) which extends around the opening. The elastic cord 30 preferably is long enough to fit over a wide range of vehicle hatches. In addition to the elastic cord 30, the fastener system may include hooks and short cords connecting the tent cover 18 to the roof rack and bumper of the vehicle. The tent cover 18 may also be secured to the ground with conventional pegs 17 and loops 19 secured through openings 21 (exaggerated in size) with the loops 19 extending around the inflatable frame 14.

The inflatable frame 14 as shown is formed from a plurality of tubes 32 joined by two-way connectors 34, three-way connectors 36 and four-way connectors 38. A first set of tubes 32A, 32B, 32C, 32D forms a semi-circular end frame member 40 having first and second ground engaging ends 42, 44 spaced apart a fixed distance, preferably slightly larger than the width of a vehicle. The ends 42, 44 are connected by further tubes 32E, 32F, which rest on the ground, and an adaptor 46 may be suitably located at the joint between the tubes 32E and 32F. Tubes 32G, 32H form an end frame member 48 which in use engages the ground along most of its length including at ground engaging ends 50, 52 spaced apart a fixed distance, again preferably larger than the width of the vehicle to which the tent is to be attached, and preferably about the same width as the member 40. Tubes 32I, 32J, 32K, 32L, 32M and 32N form roof frame members 52, 54 and 56 extending laterally in an arc from the first end frame member 40 to the second end frame member 48. The tubes 32J, 32L and 32N are caused to be arcuate by the design of the overall frame assembly. Tubes 32P, 32Q, 32R and 32S form an intermediate frame member 58 connecting to each of the plural arcuate roof frame members 52, 54 and 56 at four way connectors 38. The intermediate frame member 58 preferably has ground engaging ends 64, 66. With this construction, the frame assembly 14 may support itself, without requiring the vehicle for support.

Figure 6:
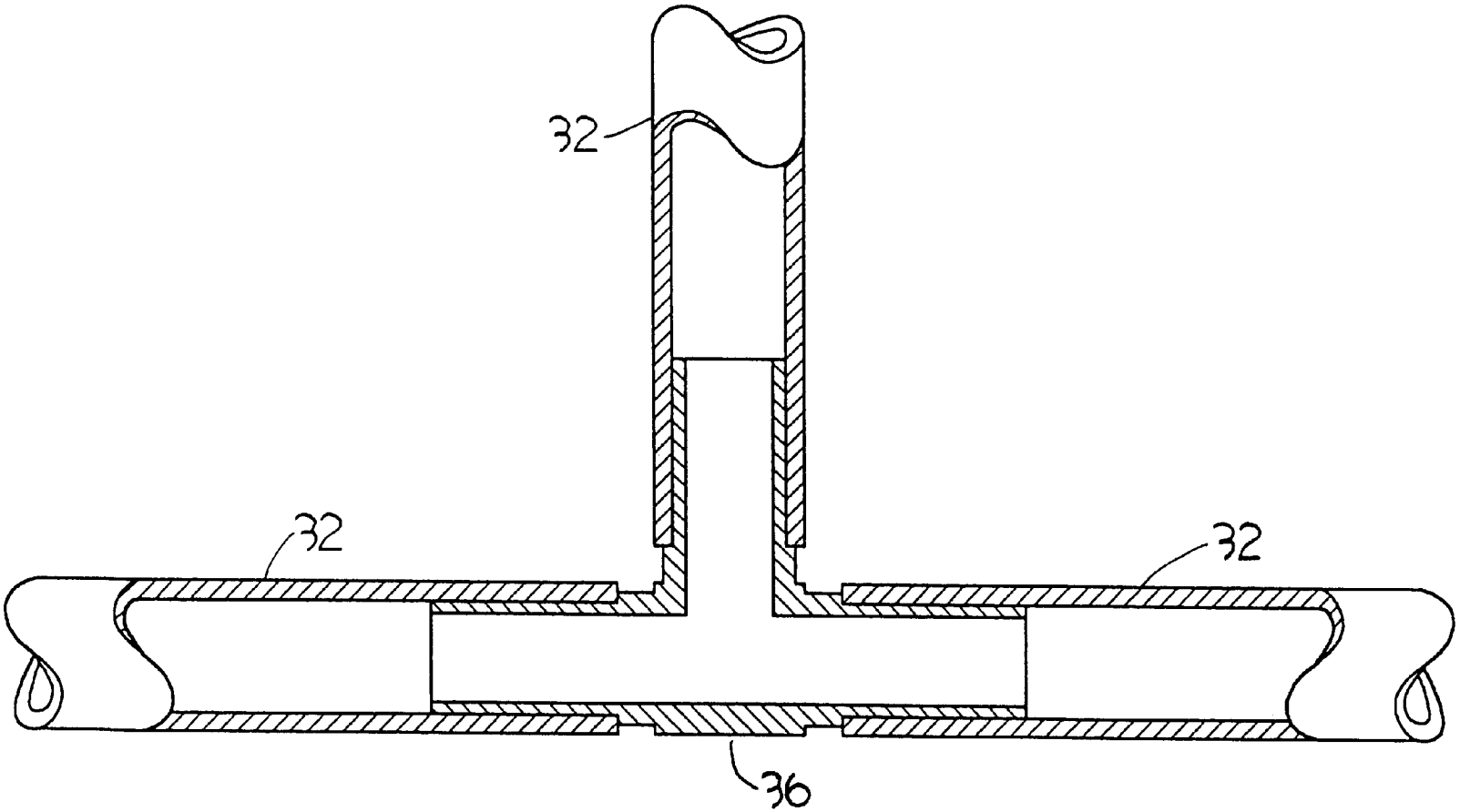
FIG. 6 is a section through a frame member showing the construction of a joint between adjacent frame members.

An exemplary three way connector 36 is shown in FIG. 6 connected to several tubes 32. The tubes 32 may be 1½ inch ID petrochemical hose available from petrochemical suppliers such as Anderson Pipe Supply in Edmonton, Canada. These tubes a rubber lined with a synthetic woven exterior. It is preferred that the tubes 32 are collapsible hollow tubes, that is, that they become flat when deflated. The connectors 34, 36 and 38 are preferably made of rubber with extensions having 1½ inch OD. The tubes 32 are glued to the connectors, and/or wrapped with tape and/or clamps or like means. The corner fittings 34 used with member 48 are preferably bowed outward to ensure that the cover material does not collapse inward.

Figure 7:
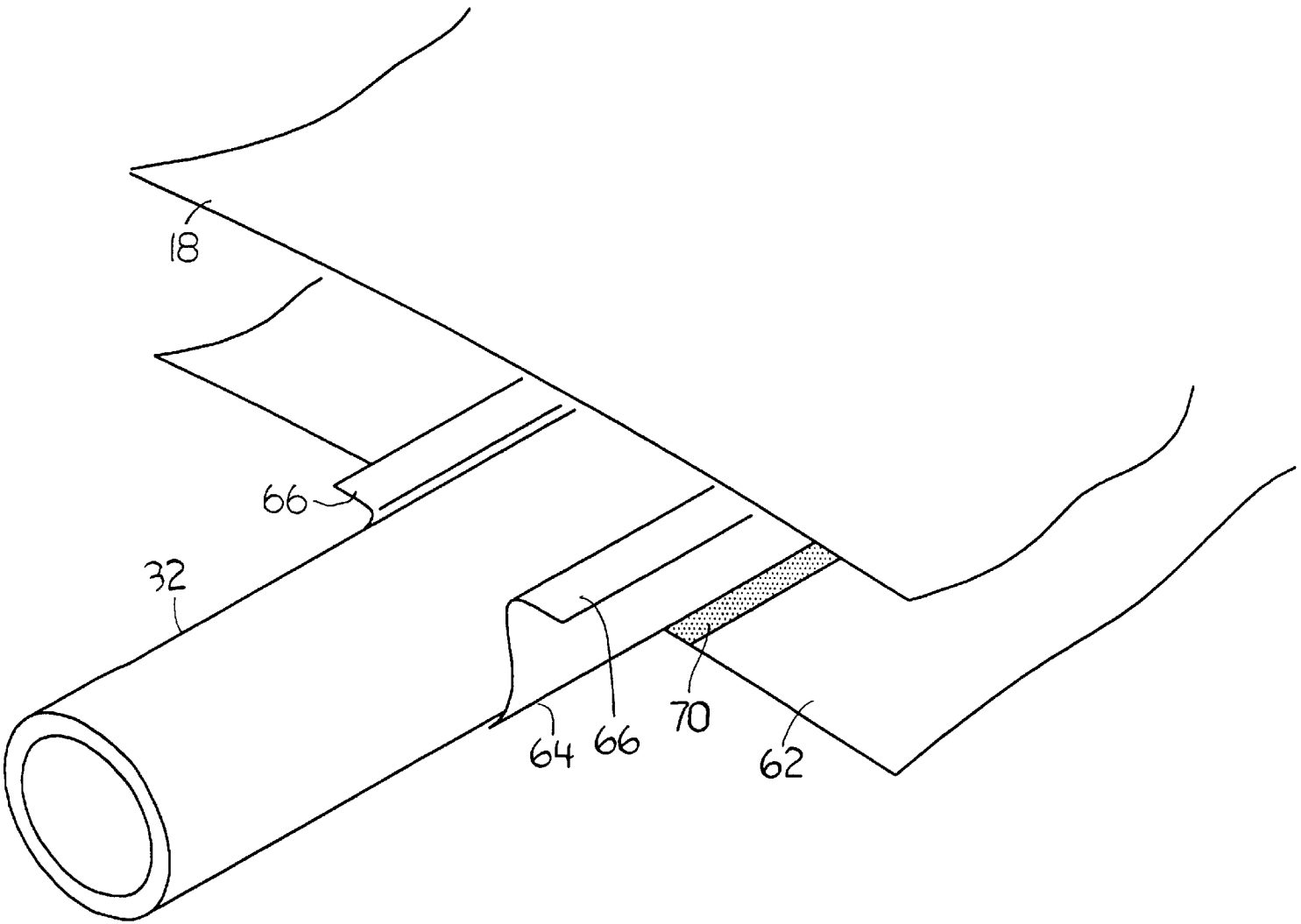
FIG. 7 is a perspective view, partly broken away, showing attachment of an inner liner for the tent of FIG. 1.

The tent cover 18 is preferably made of water proof, rip proof, UV resistant, fire resistant, durable, flexible fabric such as a rubberized heavy woven material, for example Sunbrella™ fabric, and is secured to the frame 14 by sleeves 64 (FIG. 7) or cords, or VELCRO™ strips or other fasteners. The sleeves 64 are tubes of fabric sewn together, with a flange running along the tube, and the flange is preferably sewn to the cover. The flaps 66 in FIG. 7 are sewn together to form the flange. The tubes 32 slide into the sleeves 64.

As shown in FIG. 7, an inner liner 62 is preferably disposed on the inside of the inflatable frame 14 and secured to the inflatable frame 14. The inner liner 62 may be made of a lighter material, and may be secured to the sleeves 64 by mating VELCRO™ strips 70 (one shown) running along or at intervals along the sleeves 64 and on corresponding locations on the inner liner 62.

The tent is inflated by attaching adaptor 46 to a low pressure, high volume pump such as a TRUCK AIR™ air compressor which may be carried on the vehicle. With a 12 volt compressor, the inflatable frame 14 takes about 13 minutes to inflate. For running the vehicle with the tent attached, a hose is provided to direct exhaust from the exhaust pipe to away from the tent. The tent may be provided with a variety of windows and entry/exit openings such as opening 68.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. An inflatable tent assembly for a vehicle with a rear hatch, the inflatable tent assembly comprising:

an inflatable frame, which when inflated has a shape;

a cover having the shape of the inflatable frame when the inflatable frame is inflated, the cover having a vehicle side and being sized to fit on the exterior of the inflatable frame;

an opening on the vehicle side of the cover, the opening being bounded by a peripheral edge; and a fastener system disposed around the peripheral edge for connection to the rear hatch of the vehicle, in which the inflatable frame comprises:

a first hollow end frame member having first and second ground engaging ends spaced apart a fixed distance;

a second hollow end frame member having third and fourth ground engaging ends spaced apart a fixed distance; and plural hollow arcuate roof frame members extending laterally in an arc from the first end frame member to the second end frame member.

2. The inflatable tent assembly of claim 1 further comprising:

an intermediate hollow frame member connecting to each of the plural arcuate roof frame members.

3. The inflatable tent assembly of claim 2 in which the intermediate hollow frame member has ground engaging ends.

4. The inflatable tent assembly of claim 3 in which the first hollow end frame member forms a semicircle.

5. The inflatable tent assembly of claim 4 in which the first hollow end frame member has a ground engaging portion connecting the first and second ground engaging ends.

6. The inflatable tent assembly of claim 5 in which the second hollow end frame member is ground engaging along its length.

7. An inflatable tent assembly for a vehicle with a rear hatch, the inflatable tent assembly comprising:

an inflatable frame, which when inflated has a shape;

a cover having the shape of the inflatable frame when the inflatable frame is inflated, the cover having a vehicle side and being sized to fit on the exterior of the inflatable frame;

an opening on the vehicle side of the cover, the opening being bounded by a peripheral edge; and a fastener system disposed around the peripheral edge for connection to the rear hatch of the vehicle, further comprising:

an inner liner disposed on the inside of the inflatable frame and secured to the inflatable frame.

8. An inflatable frame for a tent, the inflatable frame comprising:

a first hollow end frame member having first and second ground engaging ends spaced apart a fixed distance, the first hollow end frame member forming a semicircle;

a second hollow end frame member having third and fourth ground engaging ends spaced apart a fixed distance;

plural hollow arcuate roof frame members extending laterally in an arc from the first end frame member to the second end frame member; and an intermediate hollow frame member connecting to each of the plural hollow arcuate roof frame members and having ground engaging ends.

9. The inflatable frame of claim 8 in which the first hollow end frame member has a ground engaging portion connecting the first and second ground engaging ends.

10. The inflatable frame of claim 9 in which the second hollow end frame member is ground engaging along its length.

11. The inflatable frame of claim 8 in which the inflatable frame is made of collapsible hollow tubes.

12. An inflatable tent assembly for a vehicle with a rear hatch, the inflatable tent assembly comprising:

an inflatable frame, which when inflated has a shape;

a cover having the shape of the inflatable frame when the inflatable frame is inflated, the cover having a vehicle side and being sized to fit on the exterior of the inflatable frame;

an opening on the vehicle side of the cover, the opening being bounded by a peripheral edge; and a fastener system disposed around the peripheral edge for connection to the rear hatch of the vehicle, in which the opening has a height and a width, the inflatable frame including a hollow end frame member adjacent the opening on the vehicle side of the cover, the hollow end frame being arcuate when inflated and having first and second ground engaging ends; and the hollow end frame when inflated having a height greater than the height of the opening and a width greater than the width of the opening.

13. The inflatable tent assembly of claim 12 in which the fastener system comprises material forming a loop at the peripheral edge of the opening, and an elastic cord passing through the loop and around the opening.

14. An inflatable tent assembly for a vehicle with a rear hatch, the inflatable tent assembly comprising:

an inflatable frame, which when inflated has a shape;

a cover having the shape of the inflatable frame when the inflatable frame is inflated, the cover having a vehicle side and being sized to fit on the exterior of the inflatable frame;

an opening on the vehicle side of the cover, the opening being bounded by a peripheral edge; and a fastener system disposed around the peripheral edge for connection to the rear hatch of the vehicle, in which the inflatable frame includes a first hollow end frame member having first and second ground engaging ends spaced apart a fixed distance and plural hollow arcuate roof frame members extending laterally in an arc from the first hollow end frame member away from the opening.

15. The inflatable tent assembly of claim 14 in which the plural hollow arcuate roof frame members terminate away from the opening at roof frame member ends; and the inflatable tent assembly further comprising:

an intermediate hollow frame member connecting to each of the plural arcuate roof frame members intermediate the first hollow end frame member and the roof frame member ends.

16. The inflatable tent assembly of claim 15 in which the intermediate hollow frame member has ground engaging ends.

17. An inflatable tent assembly for a vehicle with a rear hatch, the inflatable tent assembly comprising:

an inflatable frame, which when inflated has a shape;

a cover having the shape of the inflatable frame when the inflatable frame is inflated, the cover having a vehicle side and being sized to fit on the exterior of the inflatable frame;

an opening on the vehicle side of the cover, the opening being bounded by a peripheral edge; and a fastener system disposed around the peripheral edge for connection to the rear hatch of the vehicle, in which the inflatable frame when inflated has an arched shape in cross-section.

* * * * *

UNITED STATES PATENT AND TRADEMARK OFFICE

CERTIFICATE OF CORRECTION

PATENT NO. : 6,179,367 B1
DATED : January 30, 2001
INVENTOR(S) : F.P.H. Bowen

It is certified that error appears in the above-identified patent and that said Letters Patent is hereby corrected as shown below:

Title page,
Item [56], References Cited,
OTHER PUBLICATIONS, insert in appropriate order the following:

-- ABSTRACT of U.S. patent No. 4,176,873, Barr, et al., Dec. 4, 1979, 1 page. --

Signed and Sealed this

Eighteenth Day of December, 2001

*Attest:*

*Attesting Officer*

JAMES E. ROGAN
*Director of the United States Patent and Trademark Office*